United States Patent [19]

Francioni et al.

[11] Patent Number: 5,067,307

[45] Date of Patent: Nov. 26, 1991

[54] METHOD AND APPARATUS FOR CONTROLLING THE ADVANCE OF A WRAPPING FILM

[75] Inventors: Renzo Francioni, Prato Sesia; Duilio Pavese, Borgosesia, both of Italy

[73] Assignee: Cavanna S.p.A., Italy

[21] Appl. No.: 635,864

[22] Filed: Dec. 28, 1990

[30] Foreign Application Priority Data

Dec. 29, 1989 [IT] Italy ..... 68192 A/89

[51] Int. Cl.[5] ..... B65B 41/18; B65B 57/04; B65B 9/20

[52] U.S. Cl. ..... 53/450; 53/51; 53/550

[58] Field of Search ..... 53/450, 51, 550, 461, 53/551, 451, 389.2

[56] References Cited

U.S. PATENT DOCUMENTS

| | | | |
|---|---|---|---|
| 2,977,730 | 4/1961 | Ardner | 53/51 |
| 3,115,999 | 12/1963 | Wythe | 53/51 X |
| 3,140,573 | 7/1964 | Buttolph | 53/51 |
| 3,762,617 | 10/1973 | Matthis | 53/51 X |
| 4,009,551 | 3/1977 | Greenawalt et al. | 53/51 X |
| 4,316,566 | 2/1982 | Arleth et al. | 53/51 X |
| 4,909,018 | 3/1990 | Yamamoto | 53/51 X |

FOREIGN PATENT DOCUMENTS 1481408 7/1977 European Pat. Off. .

*Primary Examiner*—Horace M. Culver

*Attorney, Agent, or Firm*—Evenson, Wands, Edwards, Lenahan & McKeown

[57] ABSTRACT

The positions of reference marks reproduced at given intervals on a wrapping film are detected by two optical units arranged in cascade. The supply of the film is controlled by the substantially continuous monitoring of its advance.

10 Claims, 3 Drawing Sheets

METHOD AND APPARATUS FOR CONTROLLING THE ADVANCE OF A WRAPPING FILM

BACKGROUND AND SUMMARY OF THE INVENTION

The present invention relates in general to wrapping machines and has been developed with particular attention to its possible use in wrapping machines of the type normally known as "flow-pack" or "FFS" (form-fill-seal) machines.

In these machines, which are widely known in the art, the products to be wrapped advance in a substantially continuous flow towards a station or unit in which the wrapper is formed. A wrapping film constituted, for example, by laminated composites of paper-aluminium, various plastics materials, etc. is simultaneously advanced (from above or below) towards the station. In the wrapper-forming station, the film is wrapped around the products so as to form a generally tubular unfinished wrapper with a lower seal. In a closure station downstream of the wrapper-forming station, a pair of contrarotating jaws close the wrapper horizontally in the regions between successive products, separating the individual packages thus formed by a cutting action.

In many applications, the wrapping film is printed with inscriptions, graphic symbols, etc. which must appear in precisely determined positions relative to the product in the wrapper. Very tight tolerances are often imposed in this connection, for example, tolerances of the order of 1% of the overall length of the package.

There is thus a need to synchronise (or to "phase") the supply of the wrapping film precisely with the advance of the products and, in particular, with the action of the jaws which close the individual packages.

It has already been proposed in the art to use for this purpose optical means which can detect the positions of certain reference marks (for example, bands of a color which contrasts with the rest of the wrapper) reproduced on the film at given intervals correlated to the lengths of the products In some solutions adopted in the art, the optical means are located in correspondence with the reel from which the wrapping film is drawn for supply to the wrapper-forming unit.

This solution has not been found completely satisfactory, however, since it does not allow account to be taken of any variations from the expected value of the intervals at which the graphic representations are reproduced on the film. In fact, for various reasons, these marks, which are usually printed on the film, may be spaced at slightly different intervals from one reel to another, or even on the same reel for reasons connected with the printing process. Further slight variations may also be induced in some films by variations in ambient conditions or by various longitudinal stresses to which the reel is subject during printing.

According to these known solutions, therefore, the positions of the reference marks are detected a long way upstream of the position where the jaws close the wrapper. In some cases, the distance between the unwinding reel and the jaws for closing the wrapper may even be some tens of times the length of an individual package (the periodic interval) in the direction of advance of the film. In practice, this means that the synchronisation carried out with reference to the position at which the reel is unwound may be wholly ineffective or erroneous since it is subject to an error equal to the variation of the periodic interval from its expected nominal value multiplied by the number of packages separating the optical reader positioned in correspondence with the reel from the region where the jaws close the wrapper.

At least in principle, this problem can be eliminated if the positions of the reference marks are detected immediately upstream of the region where the jaws close the wrapper. In practice, this means that the optical detection means are placed downstream of the wrapper-forming station so that they monitor not the flat film unwinding from the reel but the wrapper which has been wrapped around the articles to form a tube. Detection in this position, however, is extremely difficult; in fact, the surface of the wrapper to which the marks are applied is not kept rigorously at a constant distance from the optical detector. Indeed, this distance may vary to a considerable extent, for example, when (for various reasons) there is an interruption in the supply of the articles to the wrappers. In these circumstances, the tubular wrapper, which is usually kept extended by the products within it, tends to assume an almost circular cross-section (like an onion, so to speak) which adversely affects the accuracy of the detection.

Another disadvantage is the fact that, in many cases, the wrapping film has other markings (for example, writing, symbols, etc.) to which the optical detection means are sensitive, in addition to the reference marks used to generate signals for synchronising the machine; there is thus a risk that these other markings may interfere to a greater or lesser extent with the synchronisation.

At least in some cases, this problem could be eliminated by an appropriate selection of the position of the optical detection unit so that, for example, it is exposed exclusively to the passage of the optical reference marks and not to the other visible markings. For example, for packages which are intended to assume generally flattened shapes with the other markings reproduced exclusively on the upper face of the package, the detection unit could be positioned so as to monitor only one side of the package.

This solution is quite difficult to carry out, however since it makes the system even more vulnerable to any variations in the shape of the package. In fact, it is generally considered preferable to be able to carry out the detection substantially on the center line of the film.

The object of the present invention is to provide means which can resolve the problems described above and enable correct detection and synchronisation of the wrapping machine even at very high rates of operation (for example, 1000–1200 articles/minute).

According to the present invention, this object is achieved by virtue of a method and a wrapping machine having the characteristics recited specifically in the following claims.

One aspect of the present invention also relates to a method and a machine in which the advance of the wrapping film is synchronised with particular precision in dependence on the signal supplied by the optical detection means, by the generation of a location signal (preferably produced by a differential encoder driven by the film) which relates directly to the advance of the wrapping film and not, as is the case with most prior-art solutions, to the movement of the members from which the film is unwound.

Other objects, advantages and novel features of the present invention will become apparent from the following detailed description of the invention when considered in conjunction with the accompanying drawings.

DETAILED DESCRIPTION OF THE DRAWINGS

Figure 1:
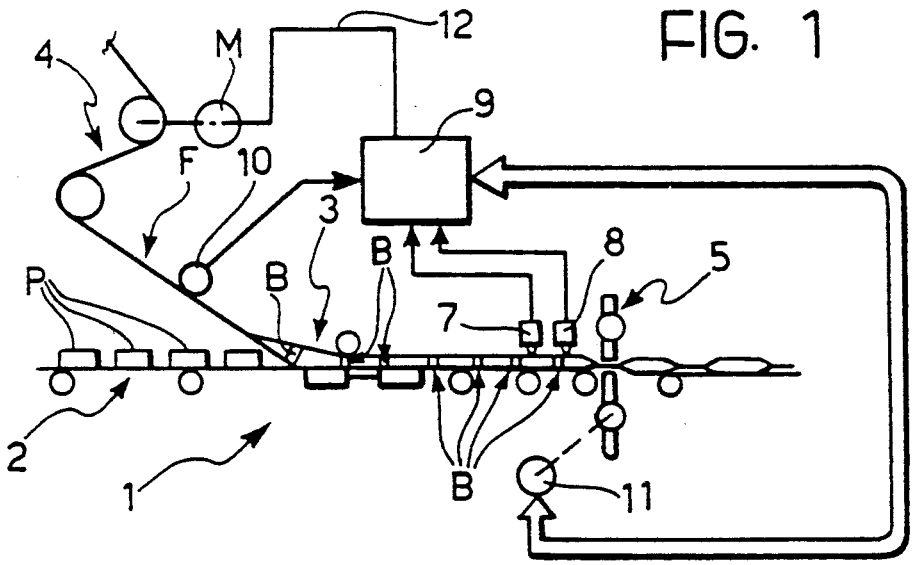
FIG. 1 shows the general structure of a wrapping machine which operates according to the invention.

In FIG. 1, a wrapping machine of the type currently known as a "flow-pack" or "FFS" machine is generally indicated 1. The general structure of such a machine may be considered widely known and does not, therefore, need a detailed description or illustration herein: in this connection, reference may usefully be made to the present Applicant's British patent application No. 2220167. Essentially, the machine 1 is intended to carry out a fully automated cycle for wrapping products P, such as bars of chocolate and the like, advancing in a substantially continuous flow (from left to right with reference to the situation of FIG. 1) on an endless conveyor (of known type).

The products P are advanced, together with a wrapping film F constituted, for example, by a laminate of paper-aluminium, polyester, polythene, etc., towards a wrapper-forming unit indicated 3.

The wrapping sheet F may be supplied either from above (as in the embodiment shown) or from below from an unwinding unit 4 (not shown as a whole in the drawings) under the control of a motor M.

The function of the wrapper-forming unit 2 is essentially to close the film F around the products P so as to form an unfinished tubular wrapper for supply to a closure unit 5. This is constituted essentially by a pair of contrarotating jaws which close the wrapper horizontally in the regions separating successive products P, welding the sides of the wrapper which are thus brought into contact and then separating the individual packages produced by a cutting action. All this takes place according to general principles which are wholly known and do not need to be described specifically herein.

In the specific field of use to which the invention relates, writing, symbols or marks are applied to the surface of the film F. In this connection, it should be stated that the term "marks" as used in this description and in the claims which follow should be understood in its widest sense so as also to include, for example, notches, cut-outs, labels, bar codes, etc., that is, any symbol or sign visible as such to an optical unit operating within or outside the visible light range (e.g. in the infra-red range).

Figure 2:
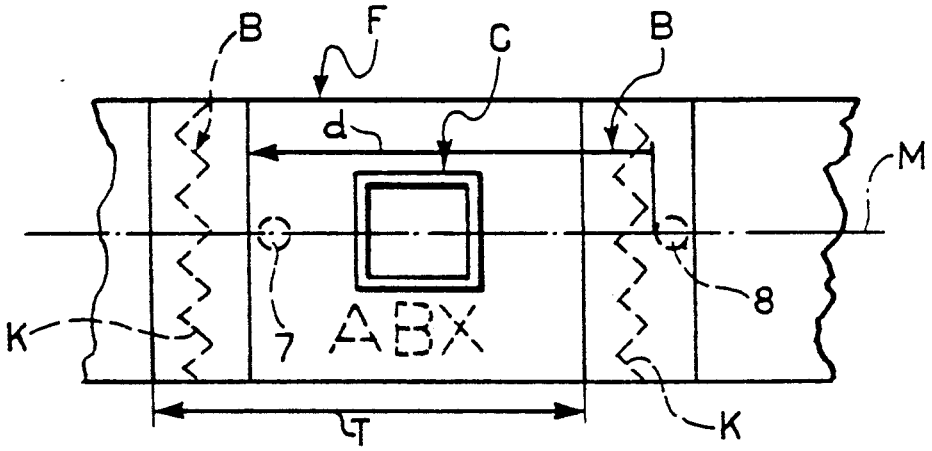
FIG. 2 shows the characteristics of a wrapping film for use in the wrapping machine of FIG. 1.

For example, in the embodiment shown in FIG. 2, transverse bands B whose appearance (colour, lustre, etc.) contrasts with that of the rest of the film F are applied to the film F at intervals T which are correlated to the dimensions of the products P (obviously measured in the direction of longitudinal advance through the machine 1) and extend across the entire width of the film F.

Further marks (writing, symbols, etc.), generally indicated C, are reproduced on the wrapper F (again at the same intervals T) in the areas between two successive bands B.

In general, it is desirable for the closure, welding and cutting jaws 5 to be able to act practically in the centres of the bands B themselves, as indicated schematically by the zig-zag broken lines K of FIG. 2.

For example, the bands B may be constituted by gilded or aluminised bands which, after the operation of the jaws 5, form decorative gold or aluminised end flaps for each individual package.

In order to achieve the desired result within the tight tolerances currently imposed in production, however, it is essential for the positions of the bands B (which are intended to act as the reference marks) to be detected very precisely so that the advance of the film F can be synchronised precisely with the advance of the products P and hence with the movement of the jaws 5.

According to the present invention, this result is achieved with the use of optical means constituted by two optical units 7, 8 (for example, photodetectors currently produced by Sick or Datalogic) located in positions in which they are exposed to the film F immediately upstream of the region in which the closure jaws 5 operate.

Each optical unit 7, 8 may comprise a light source which illuminates the passing film F and a photosensitive element. The latter is exposed to the light reflected back by the film, the intensity of which varies in dependence on the appearance of the surface of the film. The passage of the marks B and C therefore produces externally detectable variations in the signals output by the optical units 7, 8. The optical units 7, 8 are aligned with the centreline H of the film F, disposed one upstream of the other in the direction of advance of the products (and the wrapper F) towards the jaws 5, and they are spaced apart by a distance d (see FIG. 2) which differs slightly from the intervals T at which the marks B, C are reproduced on the wrapper F.

According to criteria which will be described further below, the optical units 7, 8 supply respective detection signals to a processing circuit 9 which also receives the signals supplied by a sensor 10 (preferably constituted by a differential optical encoder) which is sensitive - directly - to the advance of the film F and by a sensor 11 (preferably constituted by an absolute encoder) which is sensitive to the movement of the jaws 5 and hence to the advance of the products P.

The processing unit 9 outputs a feedback (synchronisation) signal on a line 12 to the motor M which controls the unwinding of the film F.

Naturally, since the synchronisation of several moving parts is involved, the feedback could be supplied to any of the other motors controlling the wrapping operation in the machine.

Figure 3:
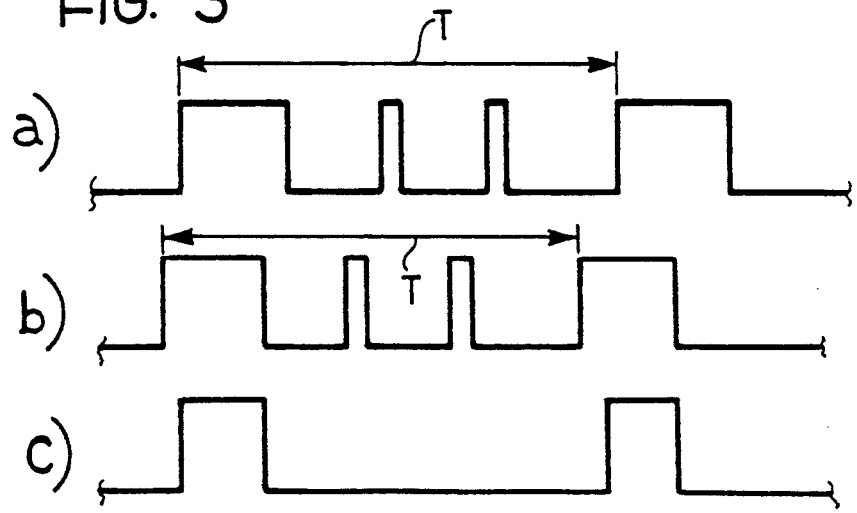
FIG. 3 is a graph showing the possible variations with time of some signals generated in the machine of FIG. 1.

The graphs a) and b) of FIG. 3 show schematically the variations in the detection signals generated by the respective photodetectors 7 and 8.

In general, these signals assume a "high" logic level when any mark B, C passes in front of one of the photodetectors.

Each of the detection signals in question thus has a fairly wide periodic pulse corresponding to the passage of the band B and one or more narrower pulses which are generated when one of the other marks C is in front of the respective photodetector.

The fact that the two photodetectors 7, 8 are separated by a distance d which differs from the intervals T at which the marks B, C are reproduced on the film F means that the respective detection signals are not exactly in synchronism but are out of phase to an extent determined by the size of the deviation or difference between the interval T and the distance d between the two detection units 7, 8.

In particular, the distance d is selected in relation to the interval T so that the difference or deviation is:

greater than the length (measured in the direction of advance of the film F) of the largest of the marks C whose interference with the detection is to be excluded, and less than the lengths (again measured in the direction of advance of the film F) of the bands B constituting the reference marks which are actually to be detected.

The locating signal obtained as the conjunction (AND) of the signals generated by the units 7 and 8 (the signal shown in the graph c of FIG. 3) is thus constituted by a logic signal which assumes a high level only when detection signals are produced by both optical units 7, 8. As seen above with regard to the selection of the distance d in relation to the interval T, this condition occurs only and solely in correspondence with the passage of the bands B constituting the reference marks.

The locating signal c) and, in particular, its leading edges thus provide a very precise indication of the positions of the reference marks B which are completely unaffected by the presence of the further marks C.

In this connection, the Applicant has found that it is highly preferable to select, for the deviation or difference between the interval T and the distance d, a value close to (that is, a little greater than) the length of the largest mark C.

Moreover, it should be stated that the term "conjunction" as used in the present description and in the claims which follow should be understood in its widest sense and should not be understood as being limited strictly to the presence of an AND-type logic function. In fact, it will be clear to an expert in the art that the same result can be achieved with different logic configurations (for example, by the attribution of a low logic level to the signal indicative of the detection of the passage of the marks B, C in front of the optical units) without thereby departing from the general principle of the invention. Such variants of implementation are therefore intended also to be included within the scope of the present patent.

Figure 4:
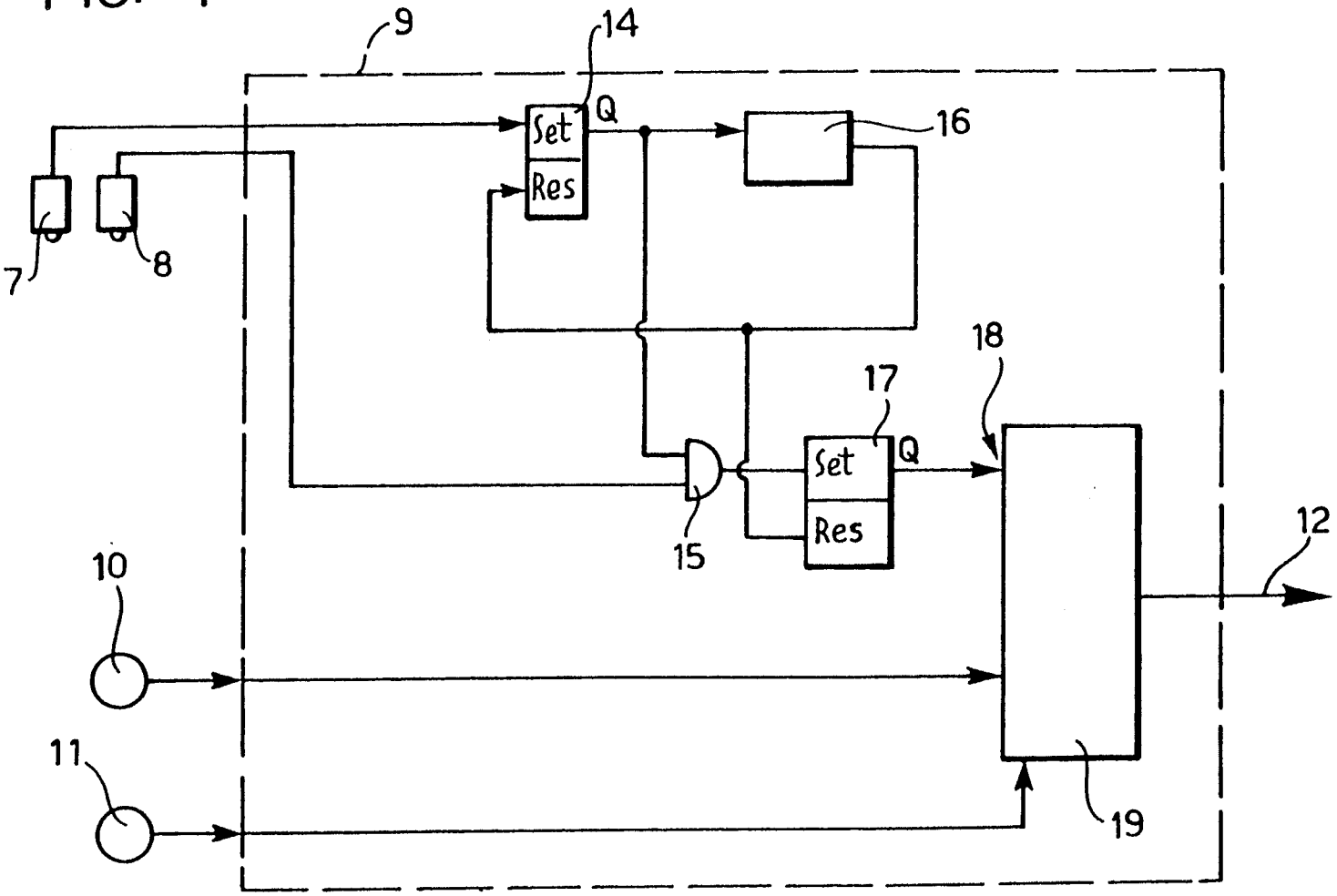
FIG. 4 shows the structure of part of the control system of the machine of FIG. 1 in the form of a block diagram and, finally.

In a preferred embodiment of the invention to which the block diagram of FIG. 4 relates, the signals generated by the optical units 7 and 8 not only undergo a simple AND operation but also logic processing which is intended mainly to prevent any fluctuations in the detection carried out by the optical unit from adversely affecting the final result.

In fact, for some reason (for example, the presence of lines, dirt, etc. on the band B), the graphs of the detection signals a) and b) may not be as clear-cut and squared as shown in FIG. 3 but may show interference peaks and interruptions.

For this reason, the output signal of the optical unit is supplied to the set input of a set-reset flip-flop 14 whose output Q is sent to one of the inputs of an AND logic gate 15, the other input of which receives the detection signal from the unit 8.

The signal at the output Q of the flip-flop 14 is intrinsically without bounce: in other words, once it has been brought to a "high" logic level as a result of the receipt of the signal from the unit 7, the signal Q remains stable at that level even in the presence of any fluctuations or interference in the signal output by the unit 7.

As well as going to the input of the logic gate 15, the signal at the output Q of the flip-flop 14 is also fed to the input of a timer (counter) 16, preferably of the on-delay type, whose output is fed back to the reset input of the flip-flop 14 to reset it after a period of time selected so as to be slightly longer than the expected durations of the pulses generated by the optical units 7, 8 as a result of the passage of the strips or bands B.

In practice, this operation means that the conjunction operation can be carried out only within a precisely predetermined time window. This achieves a further rejection of any interference induced by the passage of the marks C in front of the units 7 and 8.

A substantially analogous windowing function is carried out by a further set-reset flip-flop 17 whose set input is connected to the output of the logic gate 15 and whose reset input is connected to the output of the counter 16.

The output Q of the flip-flop 17 constitutes the output signal 18 used by the processing system 9 as the signal which identifies the positions of the reference marks B on the film F.

Figure 5:
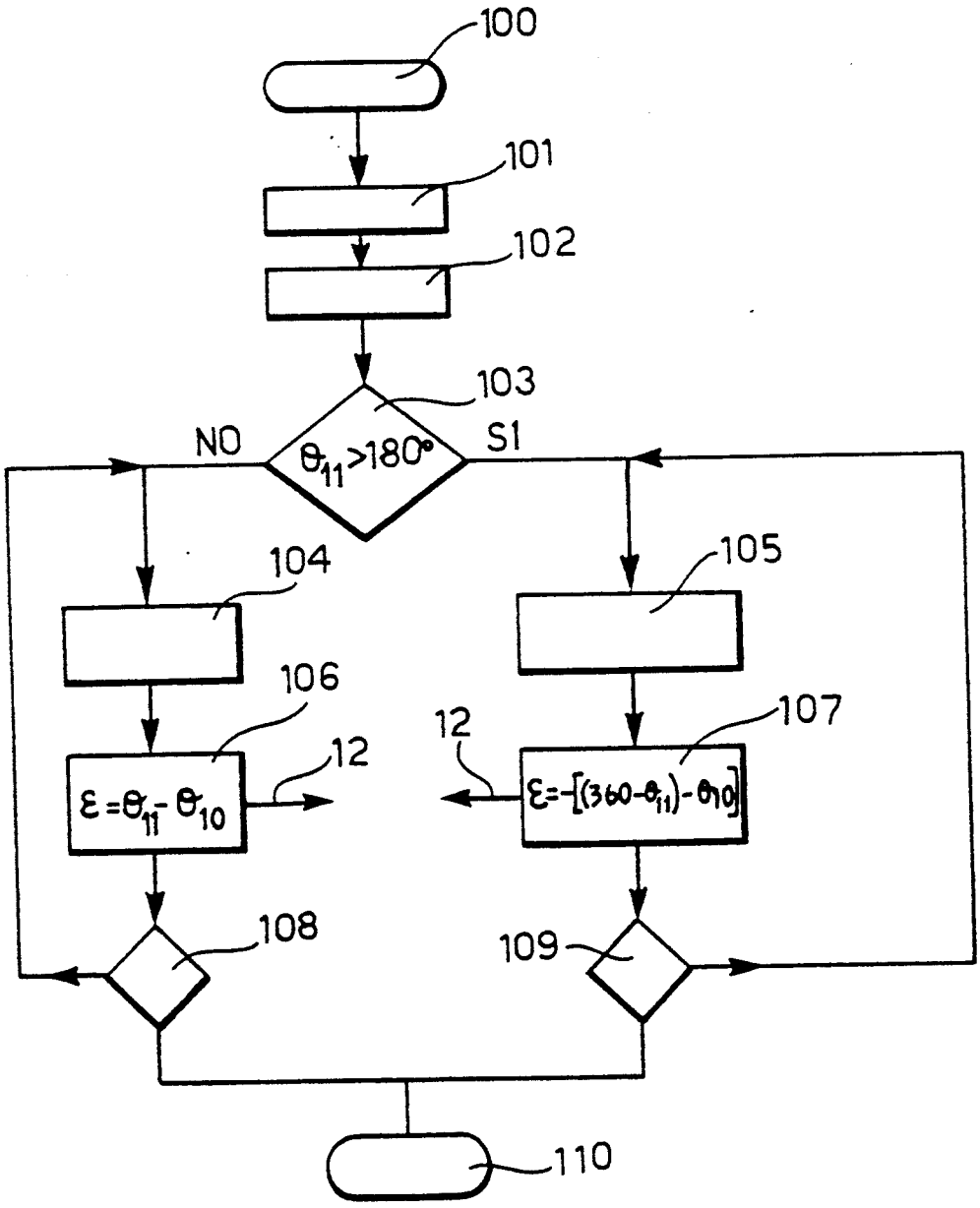
FIG. 5 is a flow chart for one of the programs regulating the operation of the system of FIG. 4.

The flow chart of FIG. 5 shows the criteria by which the processing module 9 and, in particular, its core which is constituted, for example, by a microprocessor 19 processes the position signals of the bands B, as well as the signal relating to the position of the film generated by the detector 10 and the signal indicative of the positions of the jaws 5 produced by the sensor 11, in order to provide the necessary feedback to the motor M.

As already observed, an important characteristic of the solution according to the invention is the fact that the detector 10 (which is preferably constituted by an incremental encoder driven by the film F by the direct contact of the film with the rotary feeler of the encoder) monitors the film F directly, detecting its position at all times, and not the members which control its unwinding or entrainment (for example the motor M).

This is very important for enabling account to be taken of unpredictable phenomena such as, for example, the so-called slippage of the film F. This phenomenon may result, for example, from the non-uniform thickness of the film, the presence of release agents thereon, etc., and means that, even if the speed of the unwinding member is kept rigorously constant, the film F unwinds unevenly with small variations (ripples) in its speed of advance.

In particular, the microprocessor 19 can carry out an almost continuous control cycle throughout each stage in which a portion of film F corresponding to an individual package is supplied.

In other words, in the machine according to the invention, synchronisation is not related to the detection of the relative positions of the various moving members once and for all for each package. On the contrary, in the machine according to the invention, the correction of any phase differences continues throughout the formation of an individual package so as to achieve an optimum final result.

In particular, starting with an initial step 100 which is activated as a result of the receipt, on the line 18, of a position signal for a strip or band B, the microprocessor 19 first reads (step 101) the signal supplied by the sensor 11, which is an absolute sensor, then resets (step 102) the signal supplied by the sensor 10, which is incremental.

At this point, the microprocessor checks (step 103) whether the signal supplied by the detector 101 is greater than 180°, this value being with reference to a value of 360° for the overall length of each article or product P.

In other words, during step 103, the microprocessor 19 decides whether the phase error detected can be corrected more easily by an acceleration or by a deceleration.

Expressed in yet another way, in practice, during step 102, the microprocessor 19 detects which end of the product is nearest to reaching the correct position in the course of the correction operation.

According to the result of the comparison carried out in step 103 and after the instantaneous signals $\theta_{10}$ and $\theta_{11}$ supplied by the sensor 10 and 11 have been read (steps 104 and 105), the microprocessor 19 generates, on the basis of the difference between these signals, corresponding error signals to be sent on the line 12 as feedback and error-correction signals.

In particular, when the error found is less than 180 degrees, the feedback signal $\Sigma$ is calculated by the formula $$\Sigma=\theta_{11}-\Sigma_{10}$$

that is, as the difference between the signal $\theta_{11}$ of the absolute sensor 11 and the signal $\theta_{10}$ of the incremental sensor.

Otherwise, the error is calculated by an equation of the type $$\Sigma=-[360-\theta_{11})-\theta_{10}]$$

that is, taking account of the complement to 360° of the signal of the sensor 11.

The error signal thus generated is then sent on the line 12.

The detection of the error and the generation of a corresponding feedback signal, however, is carried on continuously by the microprocessor 19 throughout the time corresponding to the formation of an individual package.

This condition is detected by the microprocessor 19 in comparison steps 108 and 109 and the steps 104, 106 or 105, 107 are repeated according to the decision taken beforehand in step 103.

For example, for a wrapping machine operating at a rate of 1200 products per minute, the time involved in the formation of one wrapper is of the order of a twentieth of a second (50 milliseconds). The sequence of steps 104 and 106 or 105 and 107 in the microprocessor typically takes one millisecond.

The microprocessor 19 can therefore repeat the error correction several tens of times for each package and not just once as was the case in conventional solutions.

This achieves a very precise final result which even takes account of any variations or changes in direction of the error as a result of accidental phenomena such as the slippage of the film F whose advance is monitored continuously by the incremental encoder 10.

At the end of the cycle of formation of each individual package, the microprocessor 19 returns to a waiting stage 110 for subsequent reactivation (step 100) upon receipt of another pulse on the line 18.

What is claimed is:

1. A method of detecting, by optical means, the positions of reference marks reproduced at given intervals on a film for wrapping products advancing in a given direction in a wrapping machine, in which further marks which can be detected by the optical means are reproduced at the said intervals of the film with said reference marks having a length greater than a length of said further marks, the method including the steps of:

providing at least first and second optical detection units disposed one upstream of the other in the direction of advance of the film and separated by a distance which differs at least slightly from the said given intervals, in order to generate first and second signals relating to the passage of the marks in correspondence with the first and second optical detection units respectively, and generating a locating signal when the first and second detection signals are present simultaneously so that the locating signal is indicative of the positions of the reference marks but is substantially unaffected by the presence of the further marks;

wherein the said distance differs from the given interval by a value between the lengths of the further marks and the lengths of the reference marks, the lengths being measured in the direction of advance of the film.

2. A method according to claim 1, wherein the said value is close to the lengths of the further marks.

3. A method according to claim 1, wherein the first and second optical detection units are arranged substantially on the center line of the film.

4. A method according to claim 1, wherein the reference marks are constituted by transverse bands whose appearance contrasts with that of the rest of the film.

5. A method according to claim 1, wherein the locating signal is obtained by the conjunction of the detection signal generated by one of the optical units and a conjunction-activating signal activated by the other optical unit and its duration corresponds substantially to the time the reference marks are expected to take to pass in front of the first and second optical detection units.

6. A wrapping machine in which a flow of products is wrapped in a film advancing in a given direction, in which reference marks for the formation of packages and further marks are reproduced on the film at given intervals, and in which optical means are provided to detect the positions of the reference marks but are also sensitive to the further marks with said reference marks having a length greater than a length of said further marks, the machine including:

first and second optical detection units disposed one upstream of the other in the direction of advance of the film, the first and second optical detection units being separated by a distance which differs at least slightly from the given intervals in order to generate first and second detection signals relating to the passage of the marks in correspondence with the first and second optical detection units respectively, and processing means for generating a locating signal when the first and second detection signals are present simultaneously so that the locating signal is indicative of the positions of the reference marks but is substantially unaffected by the presence of the further marks;

wherein the first and second optical detection units are spaced apart by a distance which differs from the said given interval by a value between the lengths of the further marks and the lengths of the reference marks, the lengths being measured in the direction of advance of the film.

7. A machine according to claim 1, wherein the said value is close to the length of the further marks.

8. A machine according to claim 6, wherein the first and second optical detection units are arranged substantially on the centreline of the film.

9. A machine according to claim 6, wherein it includes:

conjunction means acting on the first and second detection signals, and timing means which can enable the conjunction means as a result of an activation signal received from one of the optical detection units and disable the conjunction means after a period of time which corresponds substantially to the time the reference marks are expected to take to pass in front of the first and second optical detection units.

10. A machine according to claim 9, wherein that it includes an enabling module connected to the output of the conjunction mans and to the output of the timing means in order to enable the output signal of the conjunction means to be emitted as a locating signal only during the said period of time.

* * * * *